US008931187B2

(12) United States Patent
Healy et al.

(10) Patent No.: US 8,931,187 B2
(45) Date of Patent: Jan. 13, 2015

(54) WAVE TECHNOLOGY

(75) Inventors: John Healy, Madbury, NH (US); Peter Dillon, Topsfield, MA (US); Christopher Adam, Newburyport, MA (US)

(73) Assignee: TBL Licensing LLC, Wilmington, DE (US)

( * ) Notice: Subject to any disclaimer, the term of this patent is extended or adjusted under 35 U.S.C. 154(b) by 206 days.

(21) Appl. No.: 13/217,935

(22) Filed: Aug. 25, 2011

(65) Prior Publication Data

US 2013/0047474 A1 Feb. 28, 2013

(51) Int. Cl.
*A43B 13/12* (2006.01)
*A43B 13/18* (2006.01)

(52) U.S. Cl.
CPC ..... *A43B 13/122* (2013.01); *A43B 13/127* (2013.01); *A43B 13/187* (2013.01)
USPC ..... 36/30 R; 36/103; 36/28; D2/896; D2/953

(58) Field of Classification Search
CPC .. A43B 13/122; A43B 13/223; A43B 13/141; A43B 13/12; A43B 13/26
USPC ..... 36/30 R, 103, 25 R, 27, 28, 35 R; D2/896, 953, 951, 960, 947
See application file for complete search history.

(56) References Cited

U.S. PATENT DOCUMENTS

| | | | |
|---|---|---|---|
| 2,557,946 | A | 6/1951 | Crooker |
| 2,627,676 | A | 2/1953 | Hack |
| 2,710,461 | A | 6/1955 | Hack |
| 2,833,057 | A | 5/1958 | Hack |
| 2,930,149 | A | 3/1960 | Hack |
| 2,941,317 | A | 6/1960 | Hack |
| 3,299,544 | A | 1/1967 | Hack |
| 3,444,632 | A | 5/1969 | Hack et al. |
| 3,936,956 | A | 2/1976 | Famolare, Jr. |
| D247,935 | S | 5/1978 | Sebestik |
| D248,796 | S | 8/1978 | Famolare, Jr. |
| 4,130,947 | A | 12/1978 | Denu et al. |
| D253,500 | S | 11/1979 | Famolare, Jr. |
| D256,400 | S | 8/1980 | Famolare, Jr. |

(Continued)

FOREIGN PATENT DOCUMENTS

| | | | |
|---|---|---|---|
| EP | 0383489 | A1 | 8/1990 |
| EP | 1264556 | A1 | 12/2002 |
| WO | 81/01234 | A1 | 5/1981 |

OTHER PUBLICATIONS

International Search Report, PCT/US2012/047176, dated Jan. 23, 2013.

(Continued)

*Primary Examiner* — Jila M Mohandesi
(74) *Attorney, Agent, or Firm* — Lerner, David, Littenberg, Krumholz & Mentlik, LLP

(57) ABSTRACT

A shoe sole having improved cushioning characteristics is disclosed. The sole includes a midsole having a top layer of material and a bottom layer of material. In one embodiment, the top layer of material may be harder than the bottom layer of material. A pattern of lugs defining a wave may be formed on the bottom layer of material. The wave may generally be in the shape of sine wave so as to provide improved cushioning characteristics for the sole. An outsole may also be formed on the bottom layer of material and an upper may be connected to the top layer of material, such that a shoe is formed.

26 Claims, 8 Drawing Sheets

(56) References Cited

U.S. PATENT DOCUMENTS

| | | | | |
|---|---|---|---|---|
| D257,186 | S | 10/1980 | Famolare, Jr. | |
| D257,701 | S | 12/1980 | Famolare, Jr. | |
| 4,262,433 | A | 4/1981 | Hagg et al. | |
| 4,348,821 | A | 9/1982 | Daswick | |
| 4,364,190 | A | 12/1982 | Yonkers | |
| 4,507,879 | A | 4/1985 | Dassler | |
| 4,547,978 | A | 10/1985 | Radford | |
| 4,593,482 | A | 6/1986 | Mayer | |
| 4,607,440 | A | 8/1986 | Roberts et al. | |
| D292,344 | S | 10/1987 | Austin | |
| D294,537 | S | 3/1988 | Le | |
| 4,833,795 | A | 5/1989 | Diaz | |
| D301,390 | S | 6/1989 | Brown et al. | |
| 4,845,863 | A | 7/1989 | Yung-Mao et al. | |
| D306,372 | S | 3/1990 | Diaz et al. | |
| 5,077,916 | A | 1/1992 | Beneteau | |
| 5,337,492 | A | 8/1994 | Anderie et al. | |
| D351,054 | S | 10/1994 | Minkin | |
| 5,469,639 | A | 11/1995 | Sessa | |
| D368,794 | S | 4/1996 | Fabio | |
| D375,616 | S | 11/1996 | Baker et al. | |
| D380,075 | S | 6/1997 | Sell, Jr. et al. | |
| D388,597 | S | 1/1998 | Gavigan | |
| 5,713,140 | A | 2/1998 | Baggenstoss | |
| 5,768,806 | A | 6/1998 | Parisotto et al. | |
| D425,690 | S | 5/2000 | Bray et al. | |
| D429,410 | S | 8/2000 | Wright | |
| 6,138,385 | A | 10/2000 | Jungkind et al. | |
| 6,219,939 | B1 | 4/2001 | Kita et al. | |
| D441,946 | S | 5/2001 | Agnew et al. | |
| 6,253,466 | B1 | 7/2001 | Harmon-Weiss et al. | |
| D449,430 | S | 10/2001 | McClaskie | |
| 6,314,664 | B1 | 11/2001 | Kita et al. | |
| 6,389,713 | B1 * | 5/2002 | Kita | 36/30 R |
| 6,401,365 | B2 | 6/2002 | Kita et al. | |
| 6,516,539 | B2 * | 2/2003 | Nishiwaki et al. | 36/28 |
| D473,041 | S | 4/2003 | Finkelberg | |
| D475,844 | S | 6/2003 | Reynolds et al. | |
| D490,225 | S | 5/2004 | McClaskie | |
| 6,807,752 | B2 | 10/2004 | Nakano et al. | |
| 6,810,605 | B2 | 11/2004 | Nakano et al. | |
| D506,053 | S | 6/2005 | Cook | |
| D506,055 | S | 6/2005 | Ringholz | |
| D514,288 | S | 2/2006 | Burg | |
| D532,190 | S | 11/2006 | Scheurer | |
| 7,140,126 | B2 | 11/2006 | Crane et al. | |
| D533,708 | S | 12/2006 | Earle | |
| 7,181,866 | B2 | 2/2007 | Braunschweiler | |
| 7,204,044 | B2 | 4/2007 | Hoffer et al. | |
| 7,225,564 | B1 | 6/2007 | Gillespie | |
| 7,281,343 | B2 * | 10/2007 | Riha et al. | 36/59 C |
| 7,287,340 | B2 | 10/2007 | Talbott | |
| D558,964 | S | 1/2008 | Truelsen | |
| 7,484,317 | B2 * | 2/2009 | Kita et al. | 36/27 |
| 7,513,065 | B2 | 4/2009 | Kita et al. | |
| D593,742 | S | 6/2009 | Issler | |
| 7,624,515 | B2 | 12/2009 | Kita et al. | |
| 7,665,232 | B2 | 2/2010 | Manz et al. | |
| 7,707,742 | B2 | 5/2010 | Ellis, III | |
| 7,707,743 | B2 | 5/2010 | Schindler et al. | |
| 7,779,558 | B2 | 8/2010 | Nishiwaki et al. | |
| D624,294 | S | 9/2010 | Skovgaard | |
| 7,793,429 | B2 | 9/2010 | Ellis, III | |
| 7,886,461 | B2 * | 2/2011 | Sato | 36/27 |
| 8,171,655 | B2 * | 5/2012 | Morgan | 36/18 |
| 2001/0039745 | A1 | 11/2001 | Nakano et al. | |
| 2003/0192199 | A1 | 10/2003 | Nakano et al. | |
| 2005/0000115 | A1 | 1/2005 | Kimura et al. | |
| 2006/0090372 | A1 | 5/2006 | Kim | |
| 2008/0052965 | A1 | 3/2008 | Sato | |
| 2008/0196271 | A1 | 8/2008 | Wang | |
| 2008/0263905 | A1 | 10/2008 | Tai | |
| 2008/0289224 | A1 | 11/2008 | Sink | |
| 2009/0241377 | A1 | 10/2009 | Kita et al. | |
| 2011/0016746 | A1 | 1/2011 | Callahan et al. | |
| 2011/0016749 | A1 | 1/2011 | Callahan et al. | |

OTHER PUBLICATIONS

Powell, Bryon, "Sneak Peak at La Sportiva's MorphoDynamic Technology", <www.irunfar.com/2010/07/sneak-peak-at-la-sportivas-morphodynamic-technology.html>, Jul. 27, 2010.

Run Junkie: RJ Review: The New LA Sportiva Electron. A wave of Change, <runjunkie.blogspot.com/2011/05/rj-review-new-la-sportiva-electron-wave.html>, May 28, 2011.

* cited by examiner

WAVE TECHNOLOGY

CROSS-REFERENCE TO RELATED APPLICATIONS

The present application claims the benefit of application Ser. No. 13/217,935, filed Aug. 25, 2011, entitled Wave Technology, the disclosure of which is hereby incorporated herein by reference.

BACKGROUND OF THE INVENTION

The present invention relates to articles of footwear, and in particular to articles of footwear having a sole with improved cushioning characteristics.

One of the primary focuses in the recent design of athletic footwear has been underfoot cushioning. This is primarily because, while the human foot has existing natural cushioning characteristics, such natural characteristics are alone incapable of effectively overcoming the stresses encountered during everyday activity. For example, an athlete may partake in an activity in which substantial loads are placed on the foot, joint, and muscular structures of the leg including the ankle, knee, and hip joints. Such activities include road running, track running, hiking or trail running. Trail running in particular can subject the foot and lower extremities to extreme conditions and therefore extreme loads. As one example, in trail running, as distinguished from track and road running, one might encounter rough terrain such as rocks, fallen trees, gravel or steep hills. Traversing this terrain necessarily involves large stresses to be borne by the foot. Even in less demanding environments, such as in ordinary walking or road running, the human foot still experiences significant stresses. Cushioning systems have therefore developed to mitigate and overcome these stresses.

Existing cushioning systems for footwear have tended to focus on mitigating vertical ground reaction forces in order to offset the impact associated with heel strike during gait. This is not altogether unreasonable, considering that, in some activities, the body experiences peak forces nearing 2000 N in the vertical direction. Yet, during running, walking, trail running or the like, a heel strike typically involves both vertical and horizontal forces. In fact, due to the angle of the foot and leg upon contact with the ground, up to thirty (30) percent of the forces generated are in the horizontal plane.

Many traditional cushioning systems also suffer from the problem of preloading, due in part to the nature of such cushioning systems' design. Specifically, a significant amount of existing cushioning systems utilize a continuous midsole in which each section of the midsole is susceptible to compression upon contact with the ground. In other words, traditional midsoles are continuous such that, when one portion of the midsole is compressed, an adjacent portion is also compressed. This results in large areas of the midsole being compressed at the time of ground contact, thus reducing cushioning potential and forcing the midsole to act as a monolithic structure.

Yet another concern with existing cushioning systems is that, while different cushioning systems must satisfy similar objectives, such systems often need to be tailored to a particular activity or use being undertaken. For example, the demands and needs of a trail runner in terms of cushioning may be vastly different than the demands of a casual walker. The trail runner, for instance, may have specific needs that require more substantial cushioning than the ordinary walker. In fact, in trail running protection from bruising, which may be caused by repeated impacts with rocks, roots and other irregularities, is a major concern. Quite differently, during walking and/or road running, a premium is placed on vertical compression and a stable platform.

BRIEF SUMMARY OF THE INVENTION

A first embodiment of the present invention includes a shoe sole comprising a sole member having a first layer of material overlying a second layer of material. The first and second layers of material may include first and second surfaces, respectively, where the second surface of the first layer of material may be attached to the first surface of the second layer of material along substantially the entire length thereof. The first layer of material may have a first hardness and the second layer of material may have a second hardness, with the first layer being harder than the second layer. A pattern of lugs may also be formed on the second layer of material, the lugs being arranged in a repetitive wave pattern extending along the second surface of the second layer of material.

Further aspects of the first embodiment may include first and second layers of material, which, in combination, form a solid body. In yet other aspects of the first embodiment, the first hardness of the first layer of material may be from about sixty (60) to sixty three (63) on the Asker C scale, while the second hardness of the second layer of material may be from about forty eight (48) to fifty (50) on the Asker C scale. The second surface of the second layer of material may also be partially covered by an outsole, which may conform to the second surface of the second layer of material, such that the outsole may be contiguous with the second surface of the second layer of material. Still further aspects of the first embodiment may include an outsole attached non-contiguously to the second surface of the second layer of material in the form of a plurality of strips of rubber material, as opposed to an all encompassing outsole.

Additionally, according to the first embodiment, the repetitive wave pattern may be one of: (1) a low frequency, high amplitude wave; (2) a mid frequency, mid amplitude wave; and (3) a high frequency, low amplitude wave. Selected ones of the aforementioned lugs may also, according to additional aspects of the first embodiment, extend continuously from a lateral side of the sole to a medial side of the sole. The amplitude of such selected lugs may also remain constant between the medial and lateral sides of the sole.

According to a second embodiment of the present invention, a shoe sole is provided and comprises an outer surface having a pattern of lugs extending lengthwise along a longitudinal axis of the sole. The lugs may define a sinusoidal wave pattern and may be symmetrically arranged such that each lug is configured to: (1) vertically compress in a direction generally normal to the longitudinal axis of the sole; (2) horizontally deflect in a first direction extending generally parallel to the longitudinal axis of the sole; and (3) horizontally deflect in a second direction extending opposite the first direction and generally parallel to the longitudinal axis of the sole.

Other aspects of the second embodiment may include a midsole having a first layer of material overlying a second layer of material. The first layer of material may have a first hardness and the second layer of material may have a second hardness, the hardness of the first layer being greater than the hardness of the second layer. The first and second layers of material may also include first and second surfaces, respectively, where the second surface of the first layer of material is attached to the first surface of the second layer of material along substantially the entire length thereof. Further aspects of the second embodiment may include solid lugs. Each lug in the pattern of lugs may additionally be configured to vertically compress and horizontally deflect independently of adjacent lugs. Selected ones of the lugs may also extend continuously from a lateral side of the sole to a medial side of the sole. Each one of the selected lugs may further have an amplitude, which remains constant between the lateral and medial sides of the sole.

According to a third embodiment of the present invention, a shoe comprising an upper and a midsole attached to the upper is provided. The midsole may have a top layer of material overlying a bottom layer of material. The top layer of material may be connected to the bottom layer of material along substantially the entire length thereof. The top layer of material may also be harder than the bottom layer of material. A pattern of lugs may be formed on an outer surface of the bottom layer of material, the lugs being defined by a sinusoidal wave extending along the outer surface from a toe region to a heel region of the shoe.

Selected ones of the aforementioned lugs may, according to additional aspects of the third embodiment, extend continuously from a lateral side of the midsole to a medial side of the midsole. An amplitude of such lugs may also remain constant between the lateral and medial sides of the midsole. Further, an outsole may be attached and conformed to the outer surface of the bottom layer of material, such that the outsole may be contiguous with the outer surface of the bottom layer. Still further aspects of the third embodiment may include a sinusoidal wave pattern formed on the outer surface of the bottom layer of material in a direction extending from the lateral side to the medial side of the midsole.

BRIEF DESCRIPTION OF THE DRAWINGS

A more complete appreciation of the subject matter of the present invention and the various advantages thereof can be realized by reference to the following detailed description in which reference is made to the accompanying drawings.

DETAILED DESCRIPTION

In describing embodiments of the invention discussed herein, specific terminology will be used for the sake of clarity. However, the invention is not intended to be limited to any specific terms used herein, and it is to be understood that each specific term includes all technical equivalents, which operate in a similar manner to accomplish a similar purpose.

Figure 1A:
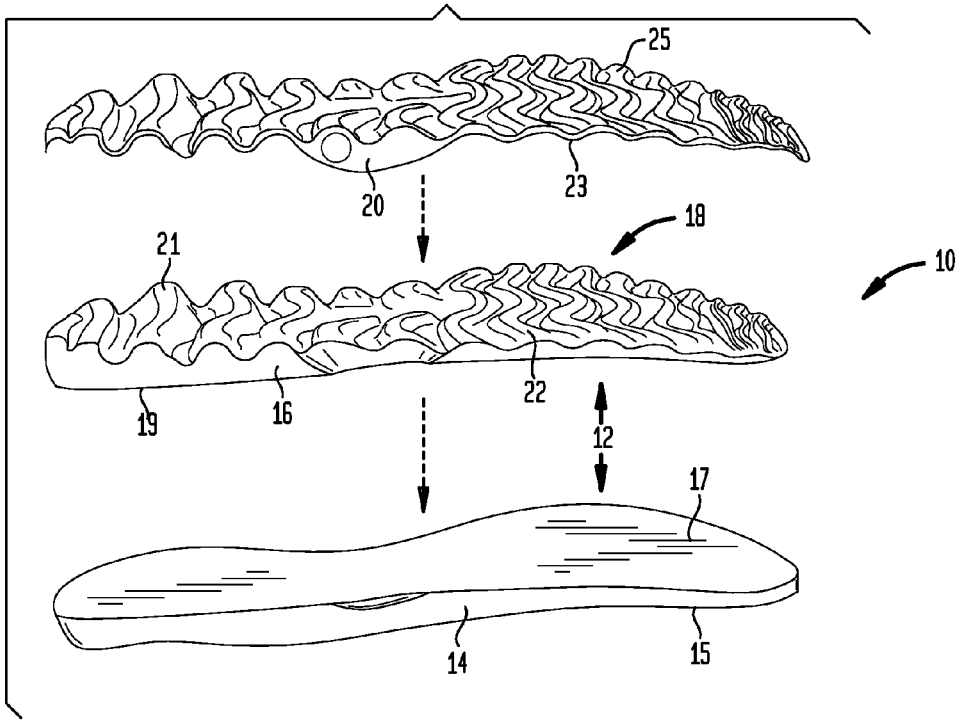
FIG. 1A is an exploded perspective view of a sole of a shoe in accordance with one embodiment of the present invention.
Figure 1B:
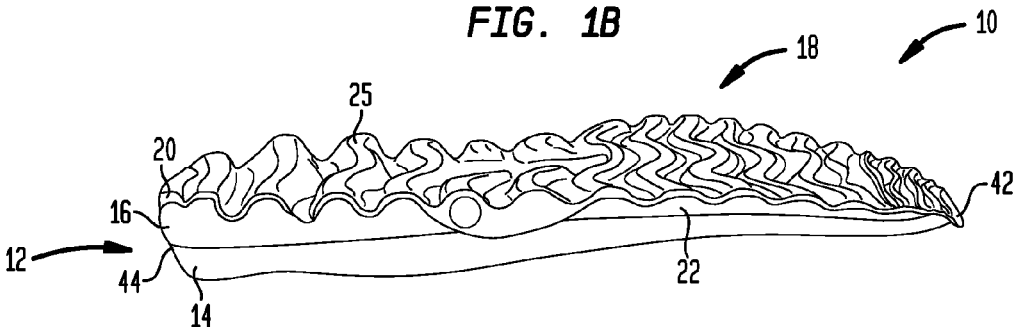
FIG. 1B is a perspective view of the sole of FIG. 1A in its assembled state.

Referring to FIGS. 1A and 1B, a sole 10 for use with a shoe (not shown) includes a midsole 12 and an outsole 20, the outsole 20 being defined by a wave pattern 18 having a plurality of lugs 22, which allow for compression of the sole 10 in specific areas.

The midsole 12 of the sole 10 may include a first layer of material 14 and a second layer of material 16. In a particular embodiment, the first layer of material 14 and the second layer of material 16 may be completely solid. The first and second layers of material 14, 16, respectively, may also have corresponding top surfaces 15, 19 and bottom surfaces 17, 21. The top surface 19 of the second layer of material 16 may abut and be connected to the bottom surface 17 of the first layer of material 14 along substantially or alternatively the entire length thereof. Thus, the first layer of material 14 may overly the second layer of material 16.

The first and second layers of material 14, 16 of the sole 10 may also vary in hardness. In other words, the first layer of material 14 may be harder than the second layer of material 16, or vice versa. As one example, the first layer of material 14 may have a hardness ranging from sixty (60) to sixty three (63) on the Asker C scale and the second layer of material 16 may have a hardness ranging from forty eight (48) to fifty (50) on the Asker C scale, thus making the first layer of material 14 harder than the second layer of material 16. In an alternate embodiment, the first layer of material 14 may have a hardness ranging from about fifty (50) to seventy (70) on the Asker C scale, while the second layer of material 16 may have a hardness ranging from about forty five (45) to sixty (60) on the Asker C scale. Hardness may also vary depending on use. For instance, the second layer of material 16 (i.e., a lower midsole) may be designed to be softer than the first layer of material 14 (i.e., an upper midsole), with the first layer of material 14 supplying support to the foot and the second layer of material 16 working as a spring object to absorb trail irregularities and provide deformation in independent areas.

In another embodiment, with the varying hardness of the first and second layers 14, 16, as described, the lugs 22 of the outsole 20 may compress into the first layer of material 14 during use, which may dissipate the forces felt by a user of the sole 10. Specifically, a particular lug 22 formed on the second layer of material 16 may compress upon contacting the ground and may be forced into a harder first layer of material 14, which, due to its rigidity, may absorb and dissipate the forces generated by such compression. Stated differently, in one embodiment, a softer second layer of material 16 may be compressed into a harder first layer of material 14, which may absorb and dissipate such compression via the relative rigidity of the first layer 14.

Still referring to FIGS. 1A and 1B, an outsole 20 of the sole 10 may overly portions or the entire bottom surface 21 of the second layer of material 16. In one embodiment, the outsole 20 may be composed of a smooth rubber material providing traction for the sole 10 (and thus the user) during use. Alternatively, the outsole 20 may be composed of a synthetic or other material having similar characteristics to rubber. Such materials may include, but are not limited to, polyurethane, EVA (ethyl vinyl acetate), synthetic rubber, and latex (i.e., natural) rubber. In yet another embodiment, the bottom surface 21 of the second layer of material 16 may serve as an outsole (i.e., the outsole 20 may be omitted altogether).

The outsole 20, if included with sole 10, further may have an inner surface 23 that is flush with the wave pattern 18 formed on the bottom surface 21 of the second layer of material 16. Thus, the inner surface 23 of the outsole 20 may be contiguous with a portion of the bottom surface 21 to which it is attached. As such, the wave pattern 18 formed on the outsole 20 may approximate or mirror the wave pattern 18 formed on the bottom surface 21 of the second layer of material 16. The outsole 20 may thusly provide a ground contacting surface 25, which mirrors the wave pattern 18 on bottom surface 21. In an alternate embodiment, the ground contacting surface 25 of the outsole 20 may roughly approximate the shape of the wave pattern 18 and may slightly deviate therefrom.

Figure 1C:
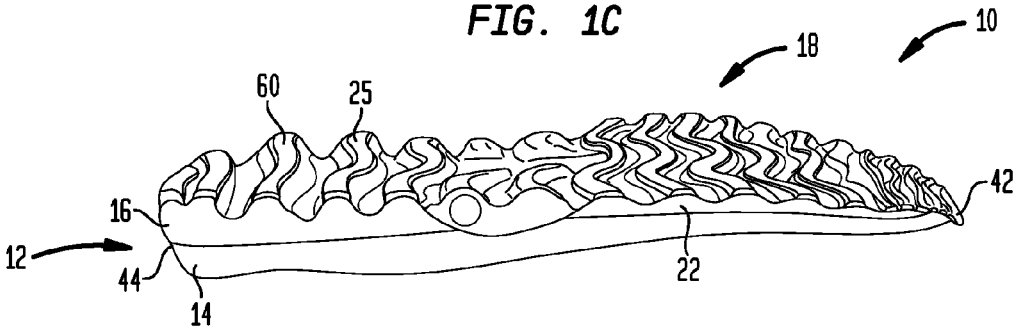
FIG. 1C is a perspective view of an alternate embodiment of the sole of FIG. 1B, including rubber pods or strips on a bottom surface of the sole.

Referring to FIG. 1C, in a particular embodiment, rubber pods or strips of rubber 60 placed in a non-contiguous fashion may be adhered to the bottom surface 21 of the second layer of material 16. The rubber pods or strips 60 may be placed at trough sections of the wave pattern 18 so as to coincide with a portion of the wave that is most likely to come in contact with the ground, e.g., ground contacting surface 25. Stated differently, crest portions of the wave pattern 18 may not contain a rubber pod or strip 60, while trough sections of the wave 18 may. In one embodiment, the rubber pods or strips 60 may provide additional traction and abrasion resistance and also may reduce the overall weight of the sole 10.

Figure 8:
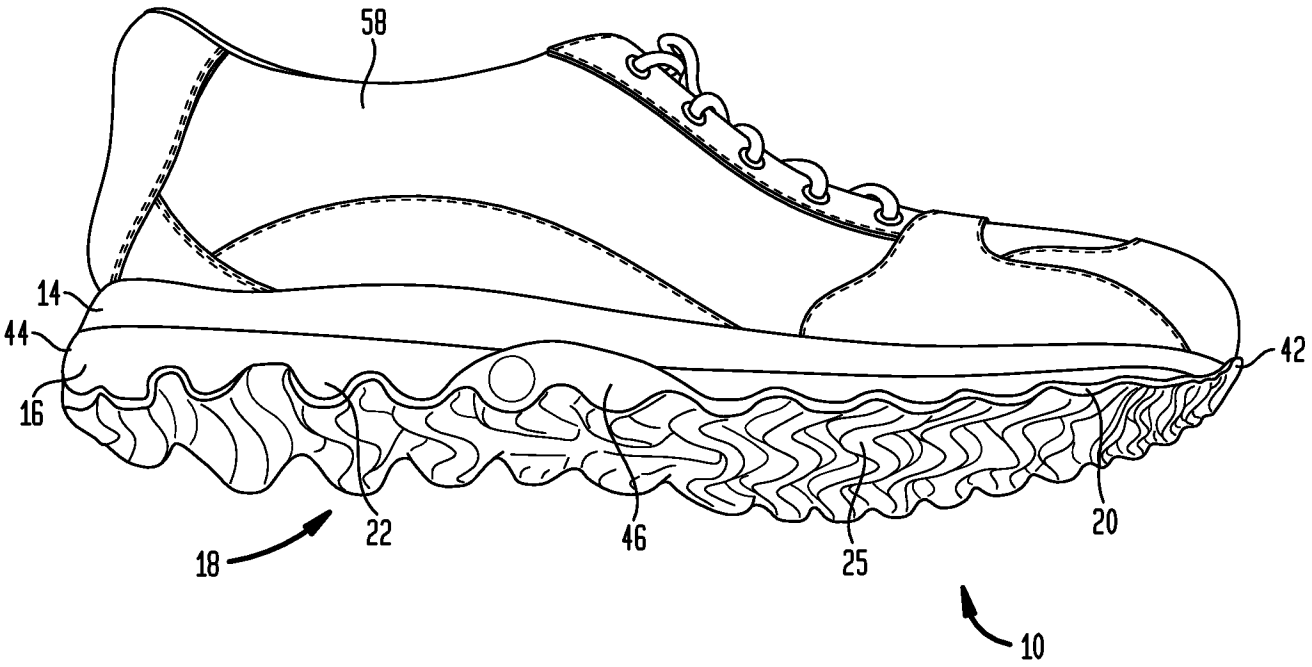
FIG. 8 is a perspective view of a shoe including the sole of FIG. 1B.

The top surface 15 of the first layer of material 14 may further be attached to an upper of a shoe, as shown in FIG. 8, so as to provide a user with an article of footwear, such as a running shoe, sandal, dress shoe, boot or the like, having a wave pattern 18 for providing improved cushioning characteristics.

Figure 2:
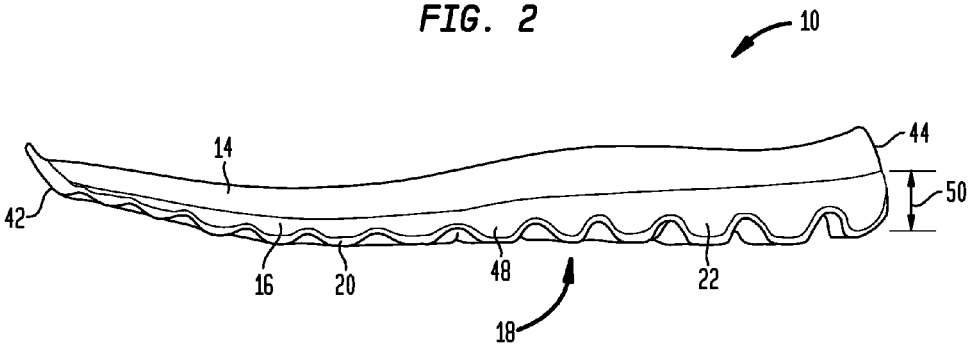
FIG. 2 is a side view of a medial portion of the sole of FIG. 1B.
Figure 3:
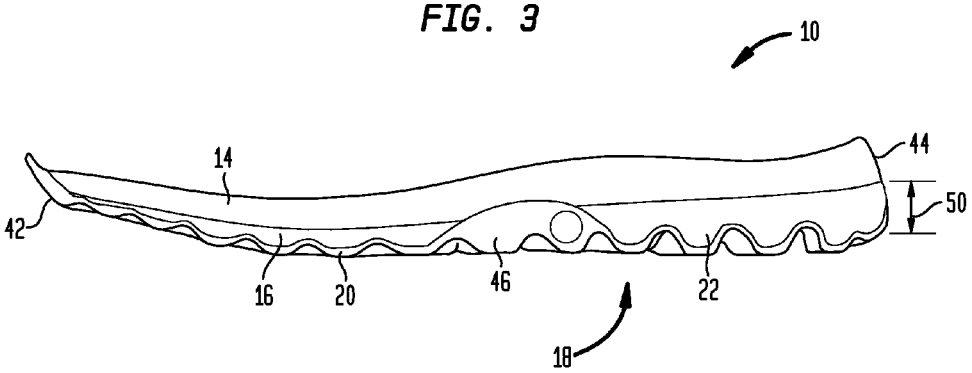
FIG. 3 is a side view of a lateral portion of the sole of FIG. 1B.

Referring to FIGS. 2 and 3, the wave pattern 18 on the bottom surface 21 of the second layer of material 16 may, in a particular embodiment, take the shape of a generally sinusoidal wave. Particular features of the wave pattern 18, such as the amplitude and frequency of the wave, may also be varied in order to obtain different cushioning characteristics. For instance, each lug 22 of the wave pattern 18 may be defined by a trough of the sinusoidal wave 18 and may have a specific amplitude 50, with all lugs 22 not necessarily sharing the same amplitude. Thus, while all lugs 22 may have the same amplitude 50 in one embodiment, it is equally contemplated that individual lugs 22 may have varying amplitudes 50. As an example, the amplitude 50 of the lugs 22 in a heel end 44 of the sole 10 may be greater than the amplitude of the lugs 22 in a toe end 42 of the sole 10, thus providing for greater cushioning in the heel end 44 of the sole 10. Specifically, a lug 22 adjacent the heel end 44 of the sole 10 may have an amplitude of approximately ten (10) millimeters and a lug 22 adjacent the toe end 42 may have an amplitude of approximately five (5) millimeters. The converse is also true, in that the lugs 22 in the toe end 42 of the sole 10 may have a greater amplitude than the lugs 22 in the heel end 44. In an alternate embodiment, the amplitude 50 of the lugs 22 may vary in cycles such that, between the toe end 42 and the heel end 44, the amplitude 50 of the lugs 22 may increase and decrease.

Several embodiments of the wave pattern 18 may also have different frequencies. Moreover, the frequency of a particular wave pattern 18 may vary along the length of the sole 10 or may remain constant along such length. For instance, a particular segment of lugs 22 on the second layer of material 16 (and thus the outsole 20) may have a high frequency relative to other such segments, meaning that the number of lugs 22 in a given distance is increased relative to other sections of the sole 10. Alternatively, a particular segment of lugs 22 on the second layer of material 16 (and thus the outsole 20) may have a low frequency relative to other such segments, meaning that the number of lugs 22 in a given distance is decreased relative to other sections of the sole 10. Wave patterns 18 of medium frequency are also contemplated. Moreover, in one embodiment, the wave pattern 18 may have a constant frequency extending from the toe end 42 to the heel end 44 of the sole 10, meaning that the number of lugs 22 in a given distance remains constant over the length of the sole 10. In a particular embodiment, a general purpose training shoe may have a frequency of one lug 22 per every two and a half (2.5) centimeters. Yet, in an alternate embodiment, one segment of sole 10 may have a frequency of a single lug 22 per every two and a half (2.5) centimeters, while other segments of sole 10 may have a higher or lower frequency of lugs 22.

Figure 4A:
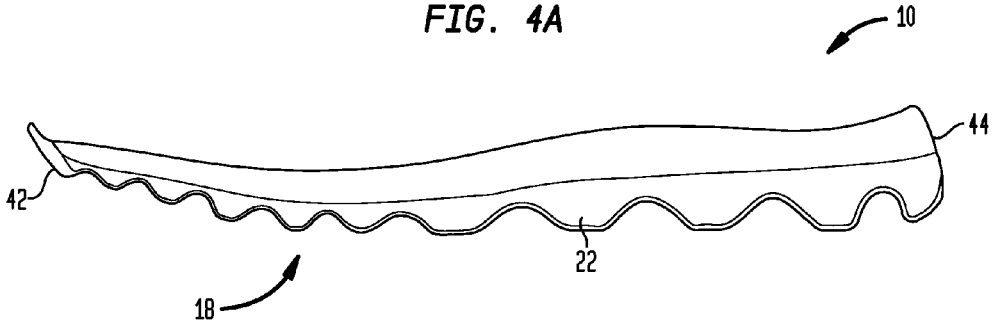
FIGS. 4A-C are cutaway views along line A-A of FIG. 5 of various wave patterns formed on a bottom surface of a sole, in accordance with further embodiments of the present invention.
Figure 4B:
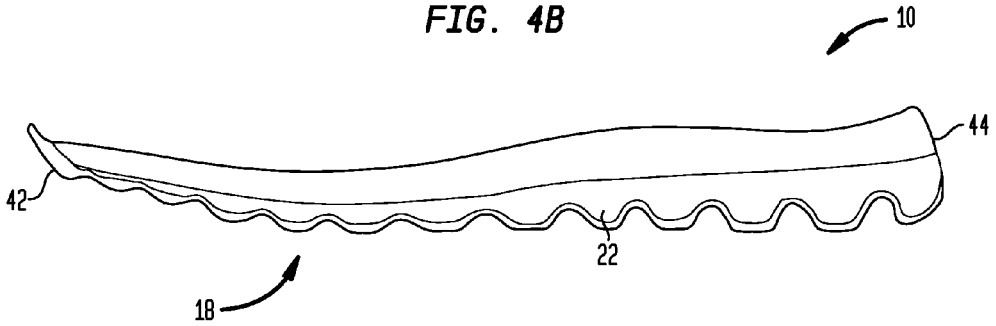
Figure 4C:
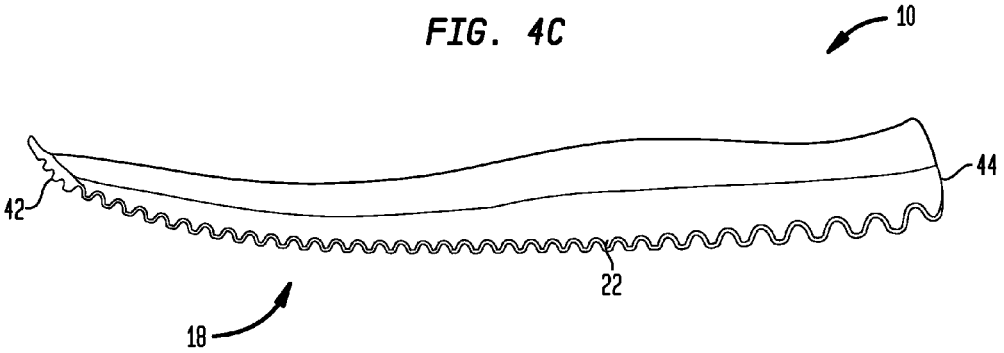

Such variations in the amplitude and frequency of the wave pattern 18, as described, provide a sole 10 having different cushioning characteristics so as to satisfy varying conditions of use. For example, as shown in the cutaway view of sole 10 in FIG. 4A, a sole predesigned for trail running may, in a particular embodiment, have a wave pattern 18 that is low in frequency yet high in amplitude. The low frequency of the wave pattern 18 may create optimal negative space to help absorb trail irregularities, and the high amplitude of the lugs 22 may provide increased compression. As another example, referring to the cutaway view of sole 10 in FIG. 4C, a sole suited for road running may, in one embodiment, have a wave pattern 18 that is high in frequency yet low in amplitude. The low amplitude of the lugs 22 may create a more stable platform for use and the high frequency of the wave pattern 18 may place more cushioning against the ground. Even further, as shown in the cutaway view of sole 10 in FIG. 4B, a sole designed to accommodate either road or trail running may, in one embodiment, have a wave pattern 18 that is of mid-frequency and mid-amplitude. Such a pattern 18 may provide a compromise between the characteristics of a "road wave" and a "trail wave." Any variation of such wave patterns 18 is therefore contemplated in order to suit the demands of different environments.

Figure 5:
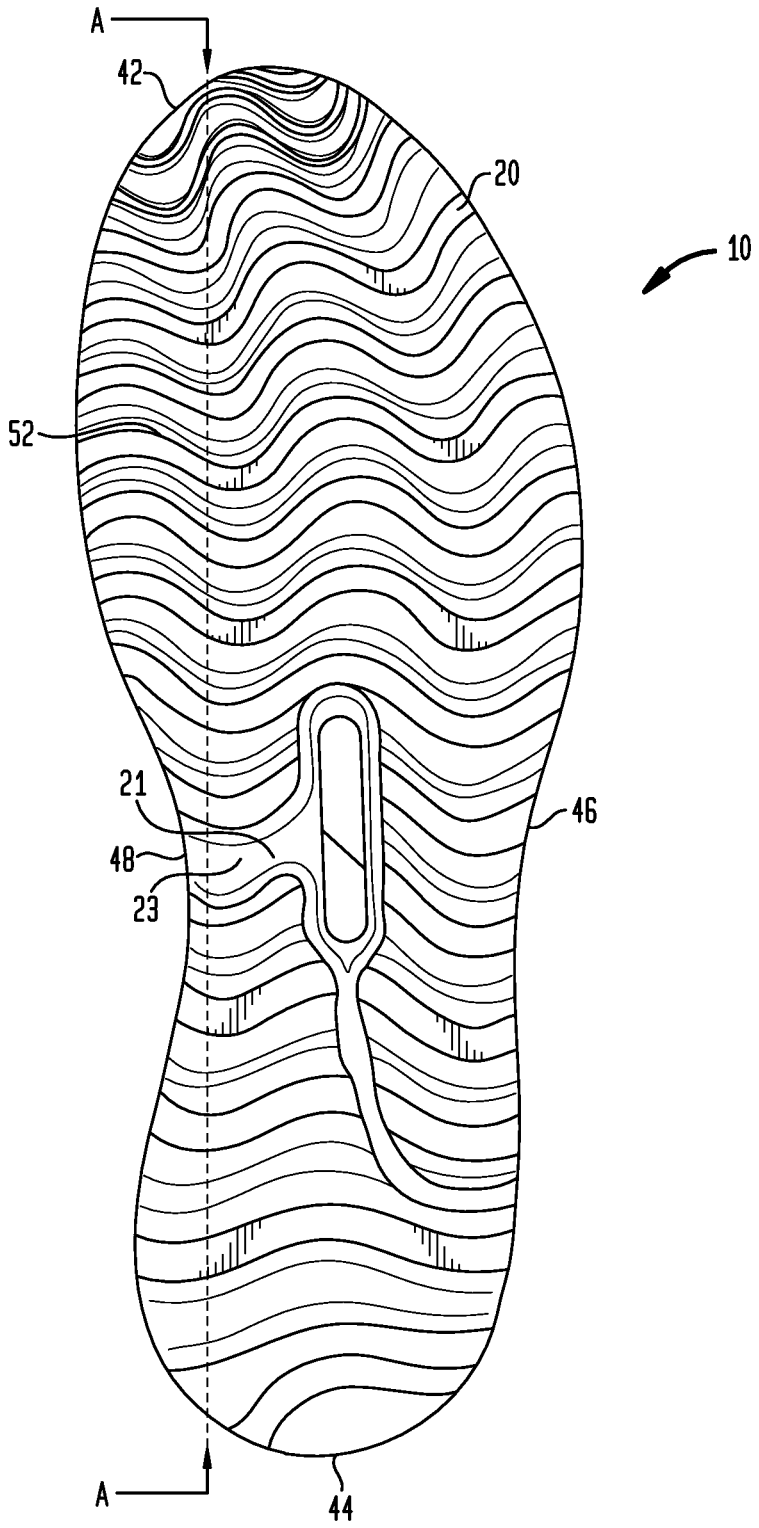
FIG. 5 is a bottom view of the sole of FIG. 1B.

Referring again to FIGS. 2 and 3, the wave pattern 18 of the sole 10 may also travel entirely from the toe end 42 to the heel end 44 of the sole 10 and may extend cross-wise from a lateral side 46 to a medial side 48 of the sole 10. Thus, the wave pattern 18 may substantially encompass the entire ground contacting surface 25 of the outsole 20; although, in an alternate embodiment, the wave pattern may encompass only portions of the ground contacting surface 25. As an example, the wave pattern 18 may be interrupted at an arch portion of the sole 10 for affixing a logo to the sole 10 (FIG. 5). Even further, in an alternate embodiment, the wave pattern 18 may be limited to one portion of the ground contacting surface 25. For instance, the wave pattern 18 may be formed in a heel region of a shoe for superior cushioning properties, but not in a forefoot or toe region of the shoe where a more traditional outsole geometry may be used.

Still referring to FIGS. 2 and 3, in the cross-wise direction (i.e., from lateral side 46 to medial side 48), the amplitude 50 of the wave pattern 18 or a particular lug 22 may remain constant. In another embodiment, the amplitude 50 of the wave pattern 18 or a particular lug 22 may instead vary in size. For instance, at a midpoint between lateral side 46 and medial side 48, a particular lug 22 may be of lower amplitude than at the extreme ends of the lateral or medial side 46, 48. Alternatively, at any particular point between lateral side 46 and medial side 48, the amplitude 50 of a specific lug 22 may be greater or less than at any adjacent point. Thus, the amplitude 50 of a lug 22 (or multiple such lugs 22) may vary in a direction extending from the lateral side 46 to the medial side 48 of the sole 10. Alternatively, the amplitude 50 of the lugs 22 may remain constant from the lateral side 46 to the medial side 48 of the sole 10, as noted above.

Referring now to FIG. 5, an outsole 20 may cover substantially the entire bottom surface 21 of the second layer of material 16 from toe end 42 to heel end 44 and from lateral side 46 to medial side 48. However, portions of the bottom surface of 21 of the second layer of material 16 may be exposed at points, such as at an arch portion 23 of the sole 10. For instance, at an arch portion 23 of the sole 10, bottom surface 21 of the second layer of material 16 may be slightly exposed so as to allow a logo to be affixed thereto. Yet, it is equally contemplated that the entire bottom surface 21 may be covered by the outsole 20.

The outsole 20 may also, in a particular embodiment, have a lateral-to-medial wave pattern 52. In other words, a wave pattern 52 may be formed in the bottom surface 21 of the second layer of material 16, and thus the outsole 20 covering the bottom surface 21, in a direction extending from the lateral side 46 to the medial side 48 of the sole 10. The wave pattern 52 may also approximate or alternatively mirror a sinusoidal wave, similar to wave pattern 18. Thus, the sole may comprise an outsole 20 in which a wave pattern is formed in both a direction extending from toe end 42 to heel end 44 and from lateral side 46 to medial side 48.

Still referring to FIG. 5, the lateral-to-medial wave pattern 52 may also, in one embodiment, have varying frequencies and amplitudes, similar to wave pattern 18. Thus, in a particular segment of outsole 20, the lateral-to-medial wave pattern 52 may have a high or low amplitude relative to other segments of the outsole 20. Similarly, in a particular segment of outsole 20, the lateral-to-medial wave pattern 52 may have a high or low frequency relative to other segments of the outsole 20. Thus, much like wave pattern 18, the lateral-to-medial wave pattern 52 may have any combination of sinusoidal patterns, such patterns having a high, medium or low amplitude and a high, medium or low frequency. In a specific embodiment, the lateral-to-medial wave pattern 52 may, nearing the heel end 44 of the sole 10, have a relatively low amplitude and frequency and, nearing the toe end 42 of the sole 10, have a relatively high amplitude and frequency. Even further, in this particular embodiment, the frequency and amplitude of the lateral-to-medial wave pattern 52 may transition from the low amplitude and frequency of the heel end 44 to the high amplitude and frequency of the toe end 42. Stated differently, the amplitude and frequency of the lateral-to-medial wave pattern 52 may be highest in toe end 42 and lowest in heel end 44, with a middle portion of the sole 10 having a wave pattern 52 with a frequency and amplitude somewhere between that of toe end 42 and heel and 44. Other configurations are also contemplated in which the frequency and amplitude of the lateral-to-medial wave pattern 52 remains constant from heel end 44 to toe end 42.

Figure 6A:
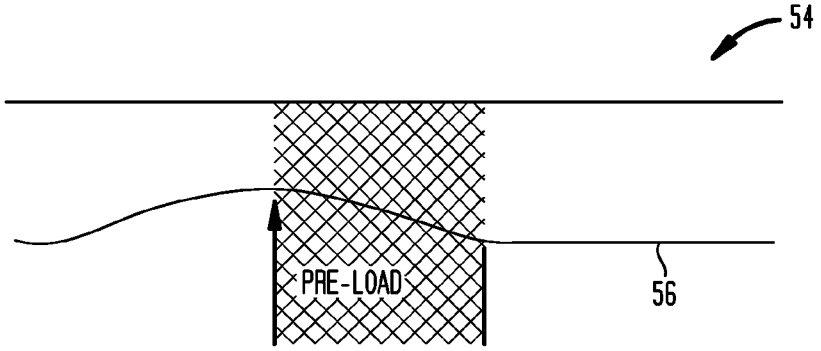
FIG. 6A is a side view of a cross-section of a conventional sole.

Referring now to FIG. 6A, a conventional sole 54 may include a continuous midsole 56, which is susceptible to the problem of "pre-loading." Specifically, upon one portion of the continuous midsole 56 being compressed, an adjacent portion may also be compressed, such that the adjacent portion is not in a fully expanded condition. The adjacent portion may therefore be "pre-loaded," such that it cannot fully absorb the impact forces generated during use. This "pre-loading" induces strain on the material that is not in direct contact with the ground and, therefore, reduces the independent nature of the structure, effectively reducing the surface area contact.

Figure 6B:
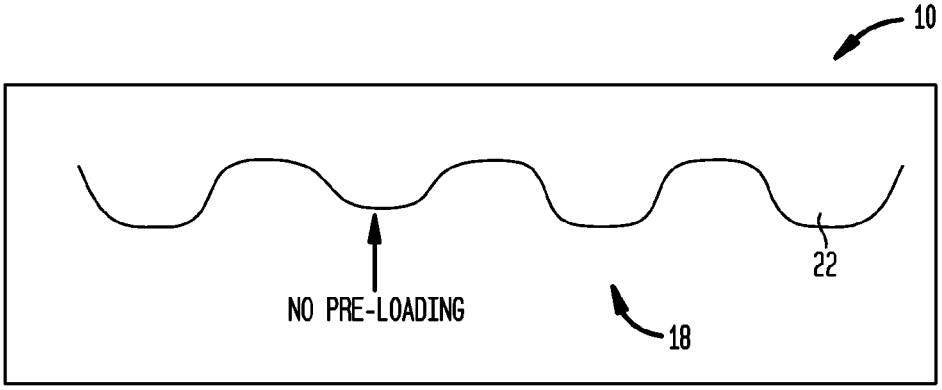
FIG. 6B is side view of a cross-section of the sole of FIG. 1B, depicted with an individual lug of the sole in a compressed state.

In contrast, referring now to FIG. 6B, individual lugs 22 of the wave pattern 18 of the sole 10 may be compressed independently of one another, thus avoiding the problem of pre-loading. Stated differently, upon contacting the ground, a particular lug 22 does not influence surrounding or adjacent lugs, allowing such adjacent lugs 22 to remain in a fully uncompressed condition isolated from the operational nearby lugs. Therefore, these adjacent lugs 22, upon contacting the ground themselves, may fully absorb the impact forces associated therewith. The shape of the wave pattern 18 of sole 10 facilitates this independent compression, thus providing a sole 10 having improved cushioning characteristics.

Figure 7A:
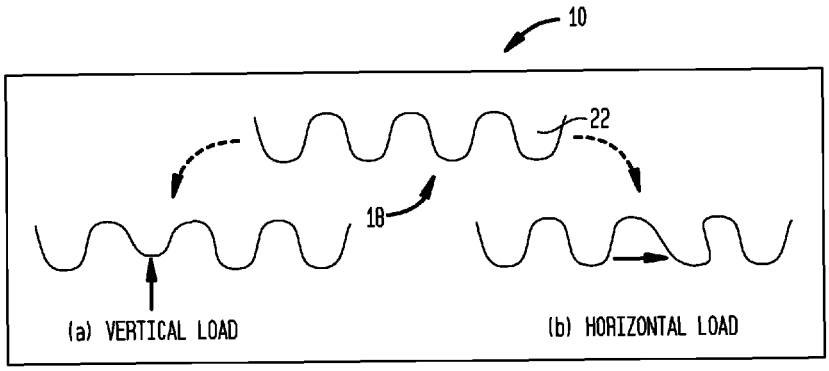
FIG. 7A is side view of a cross-section of the sole of FIG. 1B, depicted with a lug of the sole either vertically compressed or horizontally deflected.
Figure 7B:
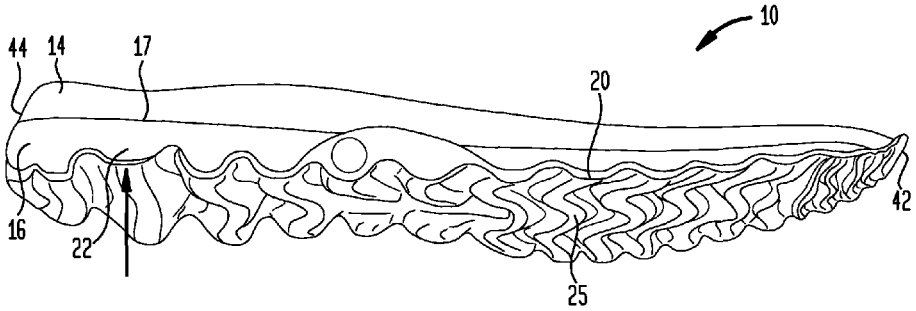
FIG. 7B is a side view the sole of FIG. 1B with a section of the sole depicted in a vertically compressed state.
Figure 7C:
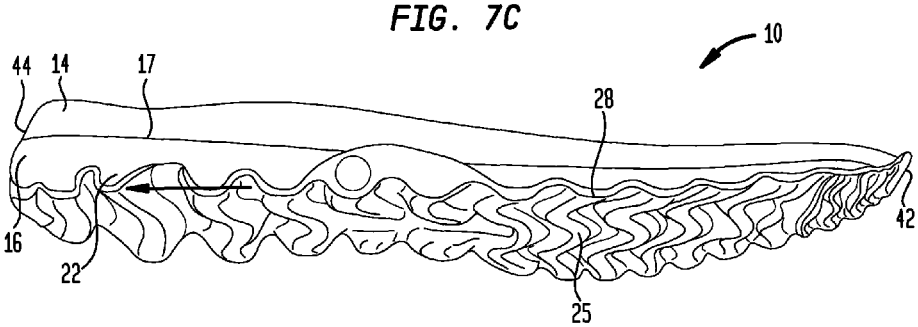
FIG. 7C is a side view of the sole of FIG. 1B with a section of the sole depicted in a horizontally deflected condition.

Referring now to FIGS. 7A-C, individual lugs 22 of the wave pattern 18, and thus portions of the wave pattern 18, may be compressed vertically or deflected horizontally so as to accommodate the forces acting on the foot during heel contact and toe off. Specifically, each individual lug 22 is capable of deflecting horizontally in a direction extending either towards toe end 42 or towards heel end 44 (FIG. 7C). Moreover, each individual lug 22 is capable of deflecting vertically towards the bottom surface 17 of the first layer of material 14 or away from the bottom surface 17 of the first layer of material 14 (FIG. 7B). As an example, during heel strike, the lugs 22 coming into contact with the ground may horizontally deflect rearward towards heel end 44 and vertically towards bottom surface 17, thus absorbing the horizontal and vertical forces associated with heel strike. Such horizontal and vertical deflection of the lugs 22 may provide a braking and transition action for the user of the sole 10. Even further, during transition from heel strike to toe off, the lugs 22 coming into contact with the ground may horizontally deflect forward towards toe end 42 and may vertically deflect initially toward bottom surface 17 and subsequently away from bottom surface 17, thus providing a force to propel the user in a forward direction. As such, the cushioning characteristics of the individual lugs 22 (and thus the wave pattern 18) provide a user of sole 10 with a smooth and efficient ride during use, due, in part, to the vertical cushioning and horizontal compliance of the lugs 22.

In the devices depicted in the figures, particular structures are shown that are adapted to provide improved cushioning for a sole of a shoe. The invention also contemplates the use of any alternative structures for such purposes, including structures having different lengths, shapes, and configurations. For example, while the top surface 19 of the second layer of material 16 has been described as being connected along substantially its entire length to the bottom surface 17 of the first layer of material 14, the second layer of material 16 may be connected to the first layer of material 14 along only portions of bottom surface 17.

As another example, although wave pattern 18 and lateral-to-medial wave pattern 52 have been described as approximating or alternatively mirroring a sinusoidal wave, other wave patterns are contemplated, such as wave patterns having a trapezoidal or triangular shape. Stated differently, while wave pattern 18 and lateral-to-medial wave pattern 52 are preferably sinusoidal in shape, the shape of wave pattern 18 and lateral-to-medial wave pattern 52 may vary from that of a sine wave while still maintaining the cushioning features described.

Still further, while the ground contacting surface 25 of the outsole 20 has been described as approximating the wave pattern 18, deviations resulting in incongruence between the shape of wave pattern 18 and ground contacting surface 25 are contemplated. Thus, the shape of ground contacting surface 25 may, in one embodiment, be similar to that of wave pattern 18, albeit with several slight variations. For instance, while the wave pattern 18 may have a rounded sinusoidal shape at the trough of the wave, a trough of the ground contacting surface 25 of the outsole 20 may be more flattened so as to provide a larger surface area for contacting the ground.

As yet another example, although a lateral-to-medial wave pattern 52 has been described as being formed on the bottom surface 21 of the second layer of material 16 (and thus the outsole 20), it is contemplated that the wave pattern 52 may not be present altogether. In other words, it is contemplated that, in a direction extending from lateral side 46 to medial side 48, no wave pattern may be present.

Moreover, while the first layer of material 14, in one embodiment, is described as having a hardness ranging from sixty (60) to sixty three (63) on the Asker C scale, and the second layer of material 16 is described as having a hardness ranging from forty eight (48) to fifty (50) on the Asker C scale, the first and second layers of material 14, 16 may have any hardness on the Asker C scale.

Even further, while, in one embodiment, a lug 22 adjacent the heel end 44 of the sole 10 may have an amplitude of approximately ten (10) millimeters and a lug 22 adjacent the toe end 42 may have an amplitude of approximately five (5) millimeters (e.g., a "mid amplitude" lug pattern), either of such lugs 22 may be increased or decreased in amplitude by a degree of zero (0) to fifty (50) percent. Stated differently, it is contemplated that the aforementioned lugs 22 in either heel end 44 or toe end 42 may be zero (0) to fifty (50) percent larger or smaller than described, thus providing either a "low amplitude" or "high amplitude" lug pattern. Moreover, although a general purpose training shoe, in one embodiment, has a frequency of one lug 22 per every two and a half (2.5) centimeters (e.g., a "mid frequency" lug pattern), the frequency of the lugs 22 of sole 10 may also be increased or decreased by a degree of zero (0) to fifty (50) percent. As such, similar to amplitude, the frequency of a particular segment of lugs 22 on sole 10 may be zero (0) to fifty (50) percent greater or less than as described, thus providing either a "low frequency" or "high frequency" lug pattern.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will also be appreciated that the various dependent claims and the features set forth therein can be combined in different ways than presented in the initial claims. It will also be appreciated that the features described in connection with individual embodiments may be shared with others of the described embodiments. For instance, the dual hardness configuration of layers 14, 16 may be employed with any of the wave lug arrangements described.

The invention claimed is:

1. A shoe sole comprising:

a sole member having a first layer of material overlying a second layer of material, the first and second layers of material including opposing first and second surfaces, respectively, wherein the second surface of the first layer of material is continuously attached to the first surface of the second layer of material along at least a portion of a length of the first surface;

the second surface of the second layer of material including a plurality of lugs arranged in a substantially sinusoidal wave pattern along a longitudinal axis of the sole, at least one of the plurality of lugs having a crest, wherein an axis extends transverse to the longitudinal axis through the crest, and the first and second layers of material, at least at the axis, form a solid body with the first layer of material being harder than the second layer of material;

the second surface of the second layer of material being either: (1) an outermost layer of the sole without another layer of material overlying it, wherein the outermost layer is positioned so as to contact the ground once the sole is incorporated into a shoe; or (2) engaged to an outsole along at least a certain length of the second surface, a combination of the outsole and the second layer of material forming a substantially sinusoidal wave pattern that is positioned so as to contact the ground once the sole is incorporated into a shoe.

2. The shoe sole of claim 1, wherein the first and second layers of material, in combination, form a solid body.

3. The shoe sole of claim 1, wherein the first layer of material, at least at the axis, has a hardness of between about 60-63 Asker C, and the second layer of material, at least at the axis, has a hardness of between about 48-50 Asker C.

4. The shoe sole of claim 1, wherein a majority of the second surface of the second layer of material is covered by the outsole, the outsole defining a substantially sinusoidal wave pattern.

5. The shoe sole of claim 4, wherein an inner surface of the outsole is attached and conforms to the second surface of the second layer of material, such that the outsole is contiguous with the second surface of the second layer of material.

6. The shoe sole of claim 1, wherein the outsole comprises a plurality of strips of material that are attached non-contiguously to the second surface of the second layer of material, a combination of the strips and the second layer of material forming a substantially sinusoidal wave pattern that is an outermost layer of the sole.

7. The shoe sole of claim 1, wherein the substantially sinusoidal wave pattern on the second layer of material is at least one of:

a low frequency, high amplitude wave;

a mid frequency, mid amplitude wave; and a high frequency, low amplitude wave.

8. The shoe sole of claim 1, wherein selected ones of the lugs extend continuously from a lateral side of the sole to a medial side of the sole.

9. The shoe sole of claim 8, wherein an amplitude of the selected lugs remains substantially constant between the medial and lateral sides of the sole.

10. The shoe sole of claim 1, wherein an amplitude of one or more of the lugs at a first section of the sole is different than an amplitude of one or more of the lugs at a second, different section of the sole.

11. The shoe sole of claim 10, wherein the first section is located at a toe region of the sole and the second section is located at a heel region of the sole.

12. The shoe sole of claim 1, wherein each of the plurality of lugs has a crest and separate axes extend transverse to the longitudinal axis through each crest of each lug, the first and second layers of material, at least at each axis, forming a solid body with the first layer of material being harder than the second layer of material.

13. A shoe sole comprising:

a sole member having a first layer of material overlying a second layer of material, the first and second layers of material including opposing first and second surfaces, respectively, wherein the second surface of the first layer of material is continuously attached to the first surface of the second layer of material along at least a portion of a length of the first surface, the second surface of the second layer of material including a plurality of lugs arranged along a longitudinal axis of the sole, at least one of the plurality of lugs having a crest, wherein an axis extends transverse to the longitudinal axis through the crest, and the first and second layers of material, at least at the axis, form a solid body with the first layer of material being harder than the second layer of material, the lugs defining a substantially sinusoidal wave pattern and being arranged such that each lug is configured to:

vertically compress in a direction generally normal to the longitudinal axis of the sole, horizontally deflect in a first direction extending generally parallel to the longitudinal axis of the sole, and horizontally deflect in a second direction extending opposite the first direction and generally parallel to the longitudinal axis of the sole.

14. The shoe sole of claim 13, wherein the lugs are solid.

15. The shoe sole of claim 13, wherein each lug is configured to vertically compress and horizontally deflect independently of adjacent lugs.

16. The shoe sole of claim 15, wherein selected ones of the lugs extend continuously from a lateral side of the sole to a medial side of the sole.

17. The shoe sole of claim 16, wherein each selected lug has an amplitude that remains substantially constant between the medial and lateral sides of the sole.

18. The shoe sole of claim 13, wherein the second surface of the second layer of material is either: (1) an outermost layer of the sole without another layer of material overlying it, the outermost layer being positioned so as to contact the ground once the sole is incorporated into a shoe; or (2) engaged to an outsole along at least a certain length of the second surface, a combination of the outsole and the second layer of material forming a substantially sinusoidal wave pattern that is positioned so as to contact the ground once the sole is incorporated into a shoe.

19. The shoe sole of claim 18, wherein a majority of the second surface of the second layer of material is covered by the outsole, the outsole defining a substantially sinusoidal wave pattern.

20. The shoe sole of claim 13, wherein an amplitude of one or more of the lugs at a heel region of the sole is different than an amplitude of one or more of the lugs at a toe region of the sole.

21. A shoe comprising:

an upper;

a midsole engaged with the upper, the midsole having a top layer of material overlying a bottom layer of material, wherein the top layer of material is continuously connected to the bottom layer of material along at least a portion of a length of the bottom layer, an outer surface of the bottom layer of material including a plurality of lugs arranged in a substantially sinusoidal wave pattern along a longitudinal axis of the midsole, at least one of the plurality of lugs having a crest, wherein an axis extends transverse to the longitudinal axis through the crest and the top layer of material is harder than the bottom layer of material, at least at the axis, the outer surface being either: (1) an outermost layer of the shoe without another layer of material overlying it, wherein the outermost layer is positioned so as to contact the ground; or (2) engaged to an outsole along at least a certain length of the outer surface, a combination of the outsole and the bottom layer of material forming a substantially sinusoidal wave pattern that is positioned so as to contact the ground.

22. The shoe of claim 21, wherein selected ones of the lugs extend continuously from a lateral side of the midsole to a medial side of the midsole, and wherein an amplitude of the selected lugs remains substantially constant between the lateral and medial sides of the midsole.

23. The shoe of claim 22, wherein an inner surface of the outsole is attached and conforms to the outer surface of the bottom layer of material, such that the outsole is contiguous with the outer surface of the bottom layer.

24. The shoe of claim 23, wherein a sinusoidal wave pattern is formed on the outer surface of the bottom layer of material in a direction extending from the lateral side to the medial side of the midsole.

25. The shoe of claim 21, wherein an amplitude of one or more of the lugs at a heel region of the midsole is different than an amplitude of one or more of the lugs at a toe region of the midsole.

26. The shoe of claim 21, wherein each of the plurality of lugs has a crest and separate axes extend transverse to the longitudinal axis through each crest of each lug, the top and bottom layers of material, at least at each axis, forming a solid body with the top layer of material being harder than the bottom layer of material.

* * * * *